US005405137A

United States Patent [19]

Vincent et al.

[11] Patent Number: 5,405,137

[45] Date of Patent: Apr. 11, 1995

[54] GOLF CLUB HEAD AND INSERT

[75] Inventors: Benoit Vincent, Annecy le Vieux; Pierre Feche, Cran Gevrier, both of France

[73] Assignee: Taylor Made Golf Company, Inc., Carlsbad, Calif.

[21] Appl. No.: 186,337

[22] Filed: Jan. 25, 1994

[30] Foreign Application Priority Data

Jan. 26, 1993 [FR] France ..... 93 00999

[51] Int. Cl.[6] ..... A63B 53/00

[52] U.S. Cl. ..... 273/173; 273/167 J

[58] Field of Search ..... 273/78, 173, 167 J

[56] References Cited

U.S. PATENT DOCUMENTS

| | | | |
|---|---|---|---|
| 3,863,932 | 2/1975 | Lezatte | 273/169 |
| 4,181,306 | 1/1980 | Jepson | 273/173 |
| 4,252,262 | 2/1981 | Igarashi | 273/174 |
| 4,809,978 | 3/1989 | Yamaguchi et al. | 273/173 X |
| 4,884,808 | 12/1989 | Retzer | 273/173 X |
| 4,984,800 | 1/1991 | Hamada | 273/173 |
| 5,176,384 | 1/1993 | Sata | 273/173 X |
| 5,221,087 | 6/1993 | Fenton et al. | 273/173 |
| 5,303,922 | 4/1994 | Lo | 273/173 |

*Primary Examiner*—William H. Grieb

*Attorney, Agent, or Firm*—Pollock, Vande Sande & Priddy

[57] ABSTRACT

A golf club head comprising a body (1) and a face insert (2) positioned in a recess (4) provided on the front part of the body, the insert being attached in the recess by a glue layer (5) interposed between the inner face (20) of the insert and the bottom (40) of the recess. The inner face (20) and the bottom are spread apart one from the other and separated by one or more abutments (60, 61, 62) so as to create a stable support for the insert (2) in the recess (4) and to form a substantially-uniform thickness of glue (e) between the inner face (20) and the bottom (40) of the recess.

9 Claims, 3 Drawing Sheets

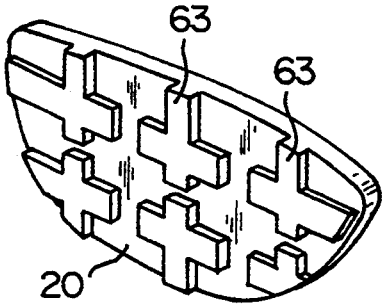
FIG. 7
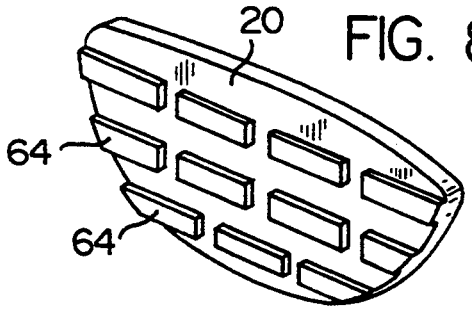
FIG. 8
FIG. 9
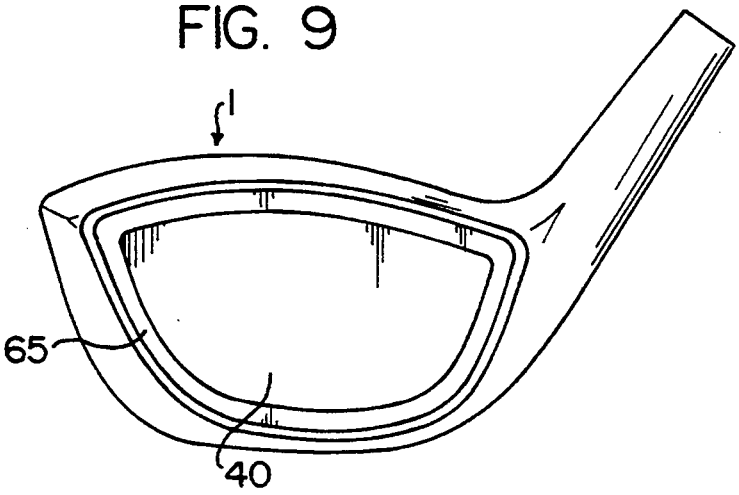
FIG. 10
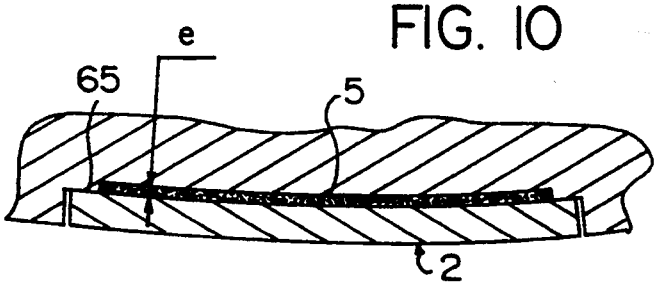

GOLF CLUB HEAD AND INSERT

FIELD OF THE INVENTION

The present invention relates to an improvement made to golf club heads, and, more particularly, those incorporating a mounted hitting face. When playing golf, the player hits the ball to move it by propelling it with a golf club consisting of a handle, normally called "shaft" in English, which comprises a head at its lower end, while its upper end is fitted with a handle, often termed a "grip" in English.

BACKGROUND OF THE INVENTION

At present, the clubs used by golfers at the tee, or starting area, to drive the ball over long distances are called "woods." In the beginning, these woods were manufactured in their entirety from woods such as persimmon or other similar varieties. These clubs are still prized by many golfers, but they have exhibit limited tolerance, because of the low density of the material used and its uniform distribution behind the hitting face of the club head.

To overcome this difficulty, the "metal-wood" club was devised, a club which has the shape of a wood, but whose head is made entirely of steel. Because of the high density of the material used and the weight constraints imposed, the metal-wood club normally comprises a hollow steel head generally manufactured using the lost wax casting process. In this type of construction, the weight, which is distributed mainly along the periphery of the impact face, gives a tolerance substantially greater than that of conventional woods. This tolerance also affects both the angle at which the ball leaves the club, which delineates the vertical trajectory thereof, and ball deviation, i.e., the lateral trajectory of the ball.

A first disadvantage of the metal-woods lies in the unpleasant sensations felt by the golfer at impact and resulting from the contact of metal on the ball surface.

Another disadvantage comes from the lack of optimal rigidity of the steel hitting face, whose thickness must be sufficient to withstand shock when the ball is struck. It may be demonstrated that a reduction of face rigidity increases the velocity of restoration, thereby producing a longer flight distance. It may in fact be shown that the rigidity of the face depends on the thickness of the hitting face and of the modulus of elasticity of the material used. For a given modulus of elasticity, reduction of rigidity is thus directly linked to a reduction of the thickness of this face. It has now become apparent that the optimal level of rigidity of the hitting face of a metal-wood corresponds to an excessively-small thickness, i.e., less than 3 millimeters, leading to irreversible deformation.

To solve this problem, Applicant's Patent Application No. FR 91 09001 proposes mounting a face insert made of a composite material on a hollow metal body.

Patent Application No. FR 92 02554 discloses an insert having a substantially-uniform thickness and adhesively bonded in the recess of the head body, whose support face has a geometric shape delineating horizontal and vertical curvature characteristics, i.e., bulge and roll, respectively.

U.S. Pat. No. 4,984,800 concerns a special process for manufacture of a golf club head consisting in attaching a face plate to a core by means of a number of studs fastened to the rear of the plate and cooperating with recesses formed in the core. The sub-assembly thus formed is placed in a mold, and injection is made of an epoxy resin which encloses the core and fills the space formed between the face plate and this core.

U.S. Pat. No. 3,863,932 concerns a club head having undergone sprueing and incorporating a relatively deep cavity, to the bottom of which a disk made of a dense metal is adhesively bonded. On one side, the disk is adjacent to a container containing glue and is covered with a transparent plastic material which fills the cavity. The plastic material is poured into the cavity, and all excess material is then removed by polishing, machining, or any other procedure.

Patent No. AU-A-30353/92 concerns an enlarged club head comprising a body incorporating a recess in which a face insert is mounted. The insert is attached inside the recess by means of a glue bead which fills a narrow peripheral container fitted on the edge of the recess.

In all cases, the importance of the positioning of the face insert in the recess is essential for obtaining precise, reproducible geometric characteristics of this face. However, positioning and bonding are very often neglected during head manufacture. The quantity of adhesive placed in the recess is poorly monitored and varies from one head to another. The insertion of the insert in the recess produce a fairly significant overflow of the adhesive onto the sides, and the thickness of the remaining adhesive is not uniform. Finally, the insert is more or less effectively well wedged into the recess because of the fluid nature of the adhesive. The geometrical characteristics of the head can vary tremendously from one head to another, an undesirable situation.

SUMMARY OF THE INVENTION

The present invention attempts to solve these problems. It concerns in general an improvement made to all heads fitted with face inserts mounted and bonded in a recess provided in the body of a club head.

One of the purposes of the invention thus lies in proposing a club head equipped with a face insert bonded satisfactorily and reproducibly. Moreover, the design of the head according to the invention makes it possible to produce absolute uniformity of the adhesive layer and to check the quantity of adhesive used for bonding. Another purpose of the invention is to allow perfect adjustment requiring no operation "after the fact" entailing the measurement, inspection, or re-machining of the face insert in the recess.

To that end, the invention concerns a golf club head comprising a body and a face insert arranged in a recess delimited by a peripheral edge and provided on the front portion of the body, this insert being fastened inside the recess by an adhesive layer interposed between the inner face of the insert and the bottom of the recess. The inner face and the bottom are spaced apart and separated by one or several support means, so as to form a stable support for the insert in the recess and to provide a substantially uniform thickness of adhesive between the inner face and the bottom of the recess.

In one embodiment of the invention, the support means form an integral part of the inner face of the insert and are supported on the bottom.

In another embodiment of the invention the support means form an integral part of the bottom of the recess housing the head and are supported on the inner face of the insert.

The support means may be constituted by three uniformly-distributed bosses constituting the vertices of a supporting triangle, so as to immobilize the insert in the recess in only one possible position.

The support means may also consist of discontinuous, uniformly-distributed or crossed ribs. A peripheral support edge may also be used.

The thickness of the adhesive in the recess preferably ranges between 0.1 and 0.4 mm.

BRIEF DESCRIPTION OF THE DRAWINGS

Other features and advantages of the invention will become apparent in the following description relating to the attached drawings provided solely by virtue of example, and in which:

FIG. 7 is a view of an insert according to another embodiment.

FIG. 8 is a view of an insert according to additional embodiment.

FIG. 9 is a front view of a head body according to a variant.

FIG. 10 is a view of a variant identical to FIG. 5.

DETAILED DESCRIPTION

Figure 1:
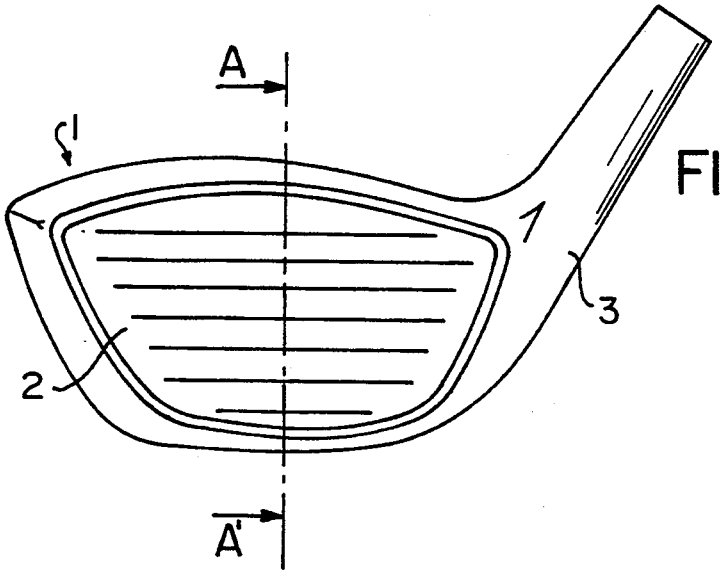
FIG. 1 is a front view of a golf club head equipped with a face insert.
Figure 2:
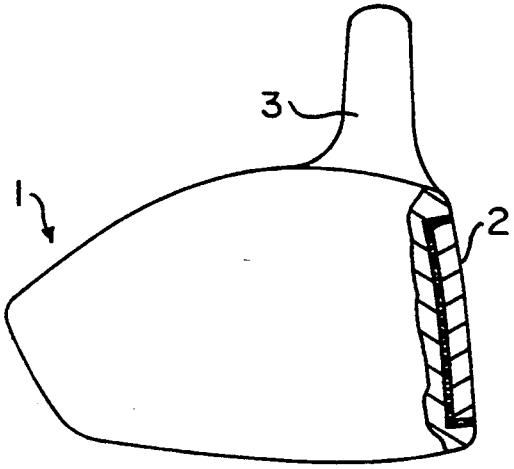
FIG. 2 is a cross-section view along line A—A' in FIG. 1 of a head according to prior art.

FIGS. 1 and 2 show golf club head according to prior art. It comprises a body 1 which may be hollow and may be constituted by an assembly of multiple peripheral walls, or else it may be solid, as illustrated. The body may be extended by a neck. The body is fitted with a mounted insert 2, which is positioned in a recess 4 in the body. The recess 4 has a bottom 40 and an inner peripheral wall 41. The insert fits into the recess and is fastened to the bottom 40 by means of an adhesive layer 5.

Figure 3:
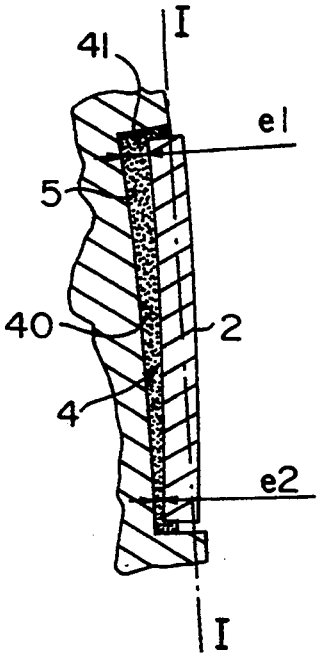
FIG. 3 is an enlarged view of detail in FIG. 2.

FIG. 3 shows a defect regarding the positioning of the insert 2 in the recess 4. The thickness of the adhesive is not uniformly distributed behind the insert ($e1 > e2$). Because of the poor distribution of the pressure exerted on the insert when it is inserted in the recess, the lower part can be driven in more fully than can the upper part, which is only partially inserted into the recess. Since the adhesive is in the fluid state when the insert is positioned, it has partially migrated upward. After the adhesive has hardened, the head must be corrected by machining the front part along the line I—I. Ultimately, the insert no longer has a uniform thickness, a fact normally harmful to club performance.

Figure 4:
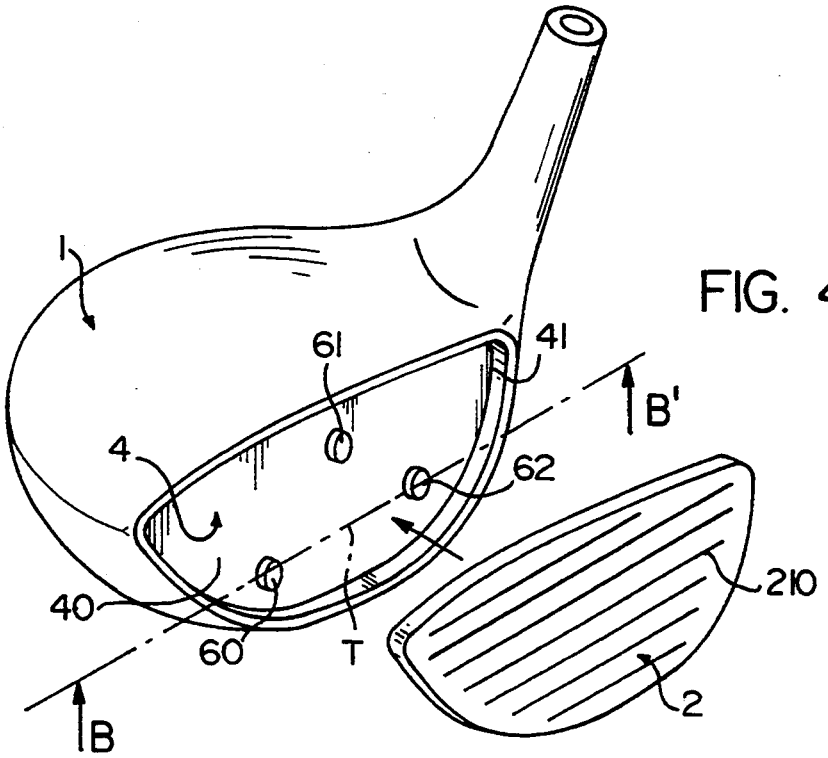
FIG. 4 is an exploded perspective view of a head according to the invention.
Figure 5:
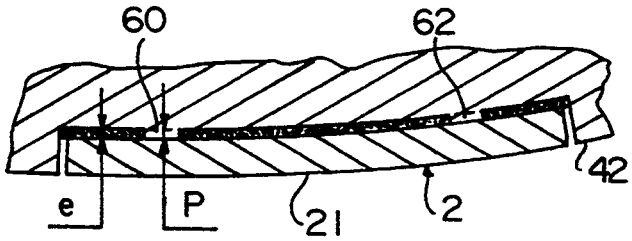
FIG. 5 is a cross-section along line B—B' of detail of the head in FIG. 4.

FIG. 4 discloses a simple solution by calling for the production, on the bottom 40 of the recess 4, of three support means in the form of bosses 60, 61, 62. These means form the vertices of a supporting triangle T, so that the insert can be immobilized in the recess in only one possible position. The outer surface 21 of the insert preferably becomes flush with the surface of the peripheral edge 42 of the recess (FIG. 5).

Prior to the insertion operation, the recess is spread with a thickness of glue at least equal to the depth p of the bosses 60, 61, 62. During assembly, the excess glue overflows each side of the insert supported on each boss. The thickness e formed between the inner surface 20 of the insert and the bottom 40 of the recess is substantially uniform, so as to impart homogeneous distribution of the glue behind the insert. No re-machining of the club head is necessary, thereby making it possible to impart to the face its final structure during the manufacturing thereof, for example by providing a series of parallel outer grooves 210.

According to one feature of the invention, the glue is spread over a large surface area of the recess. In particular, the surface area spread with the glue is greater than the surface area with which the support means are coated. This arrangement gives uniform, solid bonding at every point of the insert.

In the case of a body made of metal or injected plastic, the bosses may be produced during molding of the body. In other cases, they may be mounted attached to the bottom 40 using any means whatever, such as screwing, welding, or adhesive bonding.

Figure 6:
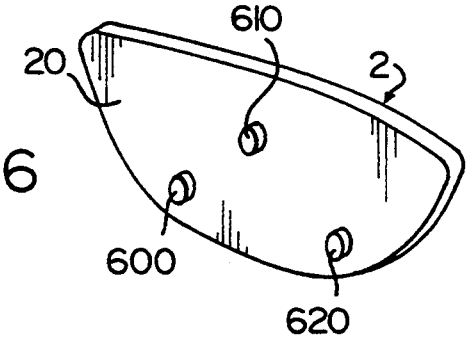
FIG. 6 is a view of a face insert according to a specific embodiment.

In FIG. 6, the bosses 600, 610, 620 belong to the inner face 20 of the insert. Similarly, the insert and support means may preferably be made of a single part by molding it of metal or plastic; or they may be mounted and attached to the inner face 20 using any suitable means.

In FIG. 7, the support means are formed by ribs 63 which project outward in relation to the bottom 40 or to the inner face 20 of the insert. These ribs are discontinuous and cross each other reciprocally in uniform fashion.

The support means may also be made, for example, of several discontinuous rectilinear ribs 64 and arranged evenly in several rows on the bottom 40 of the recess or on the inner face 20 of the insert (FIG. 8).

FIGS. 9 and 10 illustrate another case, in which the support means are a peripheral edge 65 produced on the bottom 40 of the recess. The edges of the insert are supported against that edge.

In all of the cases described, the thickness of the adhesive must be sufficient to ensure perfect adhesion.

The thickness e preferably ranges between 0.1 mm and 0.4 mm.

Of course, the type of adhesive chosen must possess good properties of adhesion with the material making up the body 1 and the insert.

Mention will be made, for example, of epoxy glues for bonding a metal body to an insert made of fiber-reinforced epoxy resin.

The shape and size of the insert are not restricted to those illustrated, and very specific sizes and shapes may be contemplated. Accordingly, the support means may exist as balls placed in the recess of the head body.

What is claimed is:

1. Golf club head comprising a body (1) and a face insert (2) arranged in a recess (4) delimited by a peripheral border (42) and provided on the front part of said body, said insert being fastened in the recess by a glue layer (5) interposed between the inner face (20) of the insert and the bottom (40) of the recess, wherein said inner face (20) and the bottom are spread apart one from the other and separated by at least one support means (60, 61, 62, 63, 64, 65) so as to form a stable support for the insert (2) in the recess (4) and to provide a substantially-uniform thickness of glue (e) between the inner face (20) and the bottom (40) of the recess.

2. Golf club head according to claim 1, wherein the outer surface (21) of the insert becomes flush with the surface of the peripheral edge (42) of the recess (4).

3. Golf club head according to claim 1, wherein said at least one support means (600, 610, 620, 63, 64) forms an integral part of the inner face and is support on said bottom (40).

4. Golf club head according to claim 1, wherein said at least one support means (60, 61, 62, 65) forms an integral part of the bottom (40) and is supported on said inner face (20) of said insert.

5. Golf club head according to claim 3, wherein said at least one support means is constituted by three bosses (60, 600, 61, 610, 62, 620) evenly arranged and forming the vertices of a supporting triangle (T), so as to lock the insert (2) in said recess (4) in only one possible position.

6. Golf club head according to claim 3, wherein said at least one support means is constituted by discontinuous, crossed projecting ribs (63).

7. Golf club head according to claim 3, wherein said at least one support means is formed by rectilinear, discontinuous projecting ribs (64) arranged evenly in several rows.

8. Golf club head according to claim 3, wherein said at least one support means is formed by a peripheral edge (65).

9. Golf club head according to claim 1, wherein the thickness of the glue (e) varies between 0.1 and 0.4 mm.

* * * * *